US005559091A

United States Patent [19]

Geboes et al.

[11] Patent Number: 5,559,091

[45] Date of Patent: Sep. 24, 1996

[54] ALKALINE CLEANING COMPOSITIONS WITH COMBINED HIGHLY HYDROPHILIC AND HIGHLY HYDROPHOBIC NONIONIC SURFACTANTS

[75] Inventors: Peter R. J. Geboes, Aartselaar; Louise G. Scott, Sterrebeek, both of Belgium

[73] Assignee: The Procter & Gamble Company, Cincinnati, Ohio

[21] Appl. No.: 432,154

[22] PCT Filed: Nov. 19, 1993

[86] PCT No.: PCT/US93/11293

§ 371 Date: May 5, 1995

§ 102(e) Date: May 5, 1995

[87] PCT Pub. No.: WO94/12599

PCT Pub. Date: Jun. 9, 1994

[30] Foreign Application Priority Data

| | | | |
|---|---|---|---|
| Nov. 26, 1992 | [EP] | European Pat. Off. | 92870191 |
| Mar. 19, 1993 | [EP] | European Pat. Off. | 93870050 |
| Jun. 18, 1993 | [EP] | European Pat. Off. | 93201757 |
| Aug. 31, 1993 | [EP] | European Pat. Off. | 93870181 |

[51] Int. Cl.[6] ..... C11D 1/825; C11D 1/72; C11D 1/722; C11D 3/30

[52] U.S. Cl. ..... 510/422; 510/365; 510/499; 510/505; 510/506

[58] Field of Search ..... 252/174.22, 174.21, 252/DIG. 1, 173, DIG. 14, 554, 535, 156, 158, 544, 548, 525, 529

[56] References Cited

U.S. PATENT DOCUMENTS

| | | | |
|---|---|---|---|
| 4,332,692 | 6/1982 | Payne et al. | 252/135 |
| 4,968,450 | 11/1990 | Kamegai et al. | 252/545 |
| 5,096,621 | 3/1992 | Tosaka et al. | 252/547 |
| 5,154,850 | 10/1992 | Deguchi et al. | 252/174.17 |

FOREIGN PATENT DOCUMENTS

| | | |
|---|---|---|
| 0540798 | 5/1957 | Canada . |
| 0360743 | 3/1990 | European Pat. Off. . |
| 1540386 | 2/1979 | United Kingdom . |

*Primary Examiner*—Ardith Hertzog
*Attorney, Agent, or Firm*—Robert B. Aylor

[57] ABSTRACT

The present invention encompasses cleaning compositions comprising a nonionic surfactant system containing a mixture of highly hydrophilic and highly hydrophobic nonionic surfactants. The present invention also encompasses a method of cleaning wherein said compositions are diluted in water before they are used to clean hard surfaces. The present invention also encompasses the diluted cleaning composition obtained in the method according to the present invention.

4 Claims, No Drawings

ALKALINE CLEANING COMPOSITIONS WITH COMBINED HIGHLY HYDROPHILIC AND HIGHLY HYDROPHOBIC NONIONIC SURFACTANTS

TECHNICAL FIELD

The present invention relates to cleaning compositions. Although the present invention applies primarily to hard surface cleaning compositions, it may also be of interest for other cleaning compositions including dishwashing and laundry detergent compositions.

BACKGROUND

Compositions which can be used in diluted form are known in the art. In such compositions, the technical problem lies in sustaining upon dilution an efficient cleaning performance. Such compositions for dilute cleaning are described for instance in the European Patent EP-A- 0 503 219. In these compositions, the dilute cleaning performance is obtained by using alkanolamines. This '219 patent application also mentions the use of nonionic surfactants among which ethoxylated fatty alcohols are listed.

Hard surface cleaning compositions comprising various surfactants, including highly ethoxylated nonionic surfactants, which can be used in diluted form are also known in the art. Representative of this prior art are the compositions described in European Patent Application EP 92870045.9.

There is a constant strive for the development of cleaning compositions with better performance in several respects. Better cleaning on all soils, including greasy soils and soap scum is of course a principal object, both for neat and diluted compositions which are often used in the cleaning of for instance hard surfaces. Such greasy soils are commonly brought by cooking with oils and fatty foods, and by simple contact with human skin, thus they are present on most surfaces, particularly in bathrooms and kitchens.

It is thus an object of the present invention to provide cleaning compositions which can be effectively used in diluted form, on various surfaces as well as in laundry applications, to clean various soils and stains. More specifically, it is a further object of the present invention to provide satisfactory shine performance and surface safety when used as hard surface cleaners.

It has now been found that this object can be efficiently met by formulating cleaning compositions comprising a specific nonionic surfactant system. Indeed, it has been found that cleaning compositions comprising at least a first nonionic surfactant with an HLB of at least 12(hydrophilic-lipophilic balance) and at least a second nonionic surfactant with an HLB below 10 and at least 4 less than the HLB of said first surfactant exhibit a great flexibility in the soils it may clean. These compositions unexpectedly exhibit outstanding cleaning performance upon dilution, compared to compositions comprising typical nonionic surfactants while the cleaning performance of the neat, i.e. undiluted compositions is similar, regardless of the presence of said nonionic surfactant system.

In other words, it has now been found that the cleaning compositions comprising a nonionic surfactant system of at least a first surfactant with an HLB of at least 12 and at least a second surfactant with an HLB below 10 and at least 4 less than the HLB of said first surfactant exhibit outstanding cleaning performance when used both neat and diluted.

Specifically, the compositions according to the present invention are especially effective on greasy soils, both when used in hard water and also when used in soft water. Indeed, a particular advantage of the present invention is robustness to different usage conditions, e.g. variations in water hardness used for diluting the product.

This invention is also particularly useful as it allows to formulate compositions with reduced levels of other ingredients, yet retaining optimal cleaning performance, due to said combination of at least a first nonionic surfactant with an HLB of at least 12 and at least a second nonionic surfactant with an HLB below 10 and at least 4 less than the HLB of said first surfactant; also, the user needs less product to achieve the same task. This advantage is particularly valuable in terms of environmental compatibility.

SUMMARY OF THE INVENTION

The present invention encompasses an aqueous cleaning composition comprising from 0.5 % to 30 % by weight of the total composition of a nonionic surfactant system, whereby said nonionic surfactant system comprises:

- at least 0.1% by weight of the total composition of a first surfactant with an HLB of at least 12;
- at least 0.1% by weight of the total composition of a second surfactant with an HLB below 10 and at least 4 less than the HLB of said first surfactant.

The present invention encompasses both neat compositions as described hereinabove and diluted compositions. Diluted compositions are obtained by diluting in water the above neat compositions comprising from 0.5% to 30% by weight of the total composition of a nonionic surfactant system. Said diluted compositions comprise from 0,001% to 5% by weight of the total composition of said nonionic surfactant system.

The present invention also encompasses a method of cleaning hard surfaces wherein a composition comprising a nonionic surfactant system, whereby said nonionic surfactant system comprises at least 0.1% by weight of the total composition of a first surfactant with an HLB of at least 12 and at least 0.1% by weight of the total composition of a second surfactant with an HLB below 10 and at least 4 less than the HLB of said first surfactant, is diluted in water and subsequently applied to said hard surface.

DETAILED DESCRIPTION OF THE INVENTION

The compositions according to the invention comprise, as an essential ingredient, a nonionic surfactant system comprising at least a nonionic surfactant with an HLB of at least 12, hereinafter referred to as highly hydrophilic surfactant and at least a nonionic surfactant with an HLB below 10 and at least 4 less than that of said highly hydrophilic surfactant, hereinafter referred to as highly hydrophobic surfactant.

Suitable nonionic surfactants for the implementation of said surfactant system are alkoxylated alcohols or alkoxylated phenylalcohols which are commercially available with a variety of alcohol chain lengths and a variety of alkoxylation degrees. By simply varying the length of the chain of the alcohol and/or the degree of alkoxylation, alkoxylated alcohols or alkoxylated phenylalcohols can be obtained with different HLB values. It is to be understood to those ordinarily skilled in the art that the HLB value of any specific compound is available from the literature.

Suitable chemical processes for preparing the highly hydrophilic and highly hydrophobic nonionic surfactants for use herein include condensation of corresponding alcohols with alkylene oxide, in the desired proportions. Such processes are well known to the man skilled in the art and have been extensively described in the art. As an alternative, a great variety of alkoxylated alcohols suitable for use herein is commercially available from various suppliers.

The highly hydrophilic nonionic surfactants for use in the present invention have an HLB of at least 12, preferably above 14 and most preferably above 15. Those highly hydrophilic nonionic surfactants have been found to be particularly efficient for a rapid wetting of typical hard surfaces covered with greasy soils and to provide effective soil suspension.

The highly hydrophobic nonionic surfactants for use in the present invention have an HLB below 10, preferably below 9 and most preferably below 8.5. Those highly hydrophobic nonionic surfactants have been found to provide excellent grease cutting and emulsification properties.

Preferred highly hydrophilic nonionic surfactants to be used in the compositions according to the present invention are surfactants having an HLB from 12 to 20 and being according to the formula $RO\text{-}(C_2H_4O)_n(C_3H_6O)_mH$, wherein R is a $C_8$ to $C_{22}$ alkyl chain or a $C_8$ to $C_{28}$ alkyl benzene chain, and wherein n+m is from 6 to 100 and n is from 0 to 100 and m is from 0 to 100, preferably n+m is from 21 to 50 and, n and m are from 0 to 50, and more preferably n+m is from 21 to 35 and, n and m are from 0 to 35. Throughout this description n and m refer to the average degree of the ethoxylation/propoxylation. The preferred R chains for use herein are the $C_8$ to $C_{22}$ alkyl chains. Examples of highly hydrophilic nonionic surfactants for use herein are LUTENSOL® AO30 (HLB=17; R is a mixture of $C_{13}$ and $C_{15}$ alkyl chains, n is 30 and m is 0) commercially available from BASF, CETALOX® 50 (HLB=18; R is a mixture of $C_{16}$ and $C_{18}$ alkyl chains, n is 50 and m is 0) commercially available from WITCO Alfonic® and 810-60 (HLB=12; R is a mixture of $C_8$ and $C_{10}$ alkyl chains, n is 6 and m is 0); and MARLIPAL® 013/400 (HLB=18; R is a mixture of $C_{12}$ and $C_{14}$, n is 40 and m is 0) commercially available from HULS.

Preferred highly hydrophobic nonionic surfactants to be used in the compositions according to the present invention are surfactants having an HLB of from 2 to 10 and being according to the formula $RO\text{-}(C_2H_4O)_n(C_3H_6O)_mH$, wherein R is a $C_8$ to $C_{22}$ alkyl chain or a $C_8$ to $C_{28}$ alkyl benzene chain, and wherein n+m is from 0.5 to 5 and n is from 0 to 5 and m is from 0 to 5, preferably n+m is from 0.5 to 4 and, n and m are from 0 to 4, more preferably n+m is from 1 to 4 and, n and m are from 0 to 4. The preferred R chains for use herein are the $C_8$ to $C_{22}$ alkyl chains. Examples of highly hydrophobic nonionic surfactants for use herein are DOBANOL® 91-2.5 (HLB= 8.1; R is a mixture of C9 and $C_{11}$ alkyl chains, n is 2.5 and m is 0) commercially available from SHELL, LUTENSOL® AO3 (HLB=8; R is a mixture of $C_{13}$ and $C_{15}$ alkyl chains, n is 3 and m is 0) commercially available from BASF; Neodol 23-3 (HLB=7.9; R is a mixture of $C_{12}$ and $C_{13}$ alkyl chains, n is 3 and m is 0) and TERGITOL® 25L3 (HLB=7.7; R is in the range of $C_{12}$ to $C_{15}$ alkyl chain length, n is 3 and m is 0) commercially available from UNION CARBIDE.

It is possible to use for each category of nonionic surfactants (highly hydrophilic or highly hydrophobic) either one of the nonionic surfactant belonging to said category or mixtures thereof.

The aqueous cleaning compositions according to the present invention comprise from 0.5% to 30% by weight of the total composition of said nonionic surfactant system, preferably from 2% to 2.5%, more preferably from 4% to 20%.

The compositions according to the present invention comprise said highly hydrophilic nonionic surfactant in an amount of at least 0.1%, preferably of at least 0.5%, more preferably of at least 2%, and said highly hydrophobic nonionic surfactant in an amount of at least 0.1%, preferably of at least 0.5%, more preferably of at least 2%.

In the compositions according to the present invention, said highly hydrophilic and highly hydrophobic nonionic surfactants may be used in a weight ratio from one to another of from 0.1: 1 to 1: 0.1, preferably of from 0.2:1 to 1:0.2.

The present invention further encompasses diluted compositions which are obtainable by diluting the compositions described hereinabove, and said diluted compositions comprise from 0,001% to 5% by weight of the total composition of the nonionic surfactant mixture described hereinabove, preferably from 0.01% to 0.5%.

In a preferred embodiment of the present invention the compositions according to the present invention further comprise an anionic surfactant. The prior art extensively describes anionic surfactants, including alkyl benzene sulfates and sulfonates, alkyl ether sulfates, paraffin sulfonates, sulfonates of fatty acids and of fatty acid esters, sulpho succinates, sarcosinates, all of which are suitable for use herein. Said anionic surfactants can also be used in the form of their salts, including sodium, potassium, magnesium, ammonium and alkanol/alkyl ammonium salts. The preferred anionic surfactants for use herein are paraffin sulfonates or alkyl sulfates, preferably in the form of their sodium or ammonium salt. The aqueous cleaning compositions according to the present invention comprise up to 15% by weight of the total neat composition of anionic surfactant, preferably from 2% to 6%.

The cleaning compositions according to the present invention may further comprise additional surfactants, including other nonionic surfactants, amphoteric and zwitterionic surfactants and mixtures thereof. Typical of these are amine oxides, betaines, sulphobetaines and the like, which are well-known in the detergency art.

The compositions according to the present invention may further comprise an alkanolamine, or mixtures thereof, in amounts ranging from 0.1% to 10% by weight of the total neat composition, preferably from 0.5% to 5%, most preferably from 0.8% to 3%. At such levels, the alkanolamine has a buffering effect for alkaline products in the undiluted product, as well as an unexpected boosting effect on the cleaning performance of the diluted compositions. Suitable alkanolamines for use in the compositions according to the present include monoalkanolamines, dialkanolamines, trialkanolamines, alkylalkanolamines, dialkylalkanolamines and alkoxyalkanolamines. Preferred alkanolamines to be used according to the present invention include monoethanolamine, triethanolamine, aminoethylpropanediol, 2-aminomethyl propanol, and ethoxyethanolamine. Particularly preferred are monoethanolamine, triethanolamine and ethoxyethanolamine.

The compositions according to the present invention may further comprise builders. Suitable builders for use herein include nitrilotriacetates (NTA), polycarboxylates, dipicolinates, citrates, water-soluble phosphates such as tri-polyphosphate and sodium ortho-and pyro-phosphates, silicates, ethylene diamine tetraacetate (EDTA), aminopolyphosphonates (DEQUEST), ether carboxylate builders such as in EP-A-286 167, phosphates, iminodiacetic acid derivatives such as described in EP-A-317 542, EP-262 112 and EP-A-399 133, and mixtures thereof. Preferred builders/sequestrants for use herein are selected from tetrapotassium pyrophosphate and citric acid. The aqueous cleaning compositions according to the present invention may comprise up to 15% by weight of the total neat composition of a builder, preferably from 1% to 10%.

The compositions according to the present invention may further comprise solvents. Suitable solvents for use herein include propylene glycol derivatives such as n-butoxypropanol or n- butoxypropoxypropanol, water-soluble CARBITOL® solvents or water-soluble CELLOSOLVE® solvents; water-soluble CARBITOL® solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE® solvents are compounds of the 2-alkoxyethoxy ethanol class, with 2-butoxyethoxyethanol being preferred. Other suitable solvents include benzyl alcohol, and diols such as 2-ethyl- 1,3-hexanediol and 2,2,4-trimethyl-1,3-pentanediol and mixtures thereof. Preferred solvents for use herein are n-butoxypropoxypropanol, BUTYL CARBITOL® and mixtures thereof. The compositions according to the present invention comprise up to 15% by weight of the total neat composition of a solvent, preferably from 3% to 10%.

The compositions according to the present invention may also comprise minor ingredients to provide aesthetic or additional product performance benefits. Typical minor ingredients include perfumes, dyes, optical brighteners, soil suspending agents, detersive enzymes, gel-control agents, thickeners, freeze-thaw stabilizers, bactericides, preservatives, hydrotopes like sodium cumene sulfonate and the like.

The present invention further encompasses a method for the cleaning of hard surfaces. According to the present invention, art aqueous cleaning composition comprising from 0.5% to 30% by weight of the total composition of a nonionic surfactant system, whereby said nonionic surfactant system comprises at least 0.1% by weight of the total composition of a first surfactant with an HLB of at least 12 and at least 0.1% by weight of the total composition of a second surfactant with an HLB below 10 and at least 4 less than said first surfactant's HLB, is diluted in water so as to obtain from 0.001% to 5% by weight of the total composition of said nonionic surfactant system and subsequently applied to said hard surface.

In the method according to the present invention, said composition is diluted into 10 to 200 times its weight of water, more preferably 50 to 150 times, before it is applied to said hard surface.

The present invention is further illustrated by the following examples.

EXAMPLE I

The following compositions were tested for their cleaning performance when used diluted on greasy soil.

The following compositions were made by mixing the listed ingredients in the listed proportions:

| Ingredients: | Compositions: #1 | #2 | #3 |
|---|---|---|---|
| | Weight % | | |
| Sodium paraffin sulfonate | 3 | 3 | 3 |
| Alcohol ethoxylate 7EO (1) | 4 | — | — |
| Alcohol ethoxylate 30EO (2) | — | 3 | 2 |
| Alcohol ethoxylate 3EO (3) | — | 1 | 2 |
| Sodium Citrate | 3 | 3 | 3 |
| Butylcarbitol | 4 | 4 | 4 |
| Triethanolamine | 1 | 1 | 1 |
| water & minors | up to 100% | | |

These compositions were evaluated for their grease removal efficiency. A high index is correlated to a high performance.

| Dilute cleaning performance (index) | Compositions #1 | #2 | #3 |
|---|---|---|---|
| Hard water | 100 | 370 | 350 |
| Soft water | 100 | 200 | 220 |

In the examples hereinabove, (1) is an ethoxylate nonionic surfactant representative of the prior art with an HLB of 12. Compounds (2) and (3) are ethoxylate nonionic surfactants according to the present invention. (2) is a highly hydrophilic nonionic surfactant with an HLB of 17, wherein R is a mixture of C13 and C15 alkyl chains and n is 30. (3) is a highly hydrophobic nonionic surfactant with an HLB of 8, wherein R is a mixture of C13 and C15 alkyl chains and alkyl chains and n is 3.

Compositions 1–3 described hereinabove can be used neat or diluted. In the present .cleaning performance test these compositions are diluted in 64 times their weight of water and subsequently applied to a hard surface.

Typical dilute grease cleaning results obtained for such compositions are given for the examples hereinabove. Composition #1 which comprises a nonionic surfactant with an moderate HLB (12) gets a cleaning index of 100 and is used as a reference.

According to the present invention, the compositions #2 and #3 which comprise a nonionic surfactant system comprising alcohol ethoxylate 30EO (an highly hydrophilic nonionic surfactant) and alcohol ethoxylate 3EO (an highly hydrophobic nonionic surfactant) exhibit outstanding cleaning performance upon dilution both in hard and soft water. Indeed, when used with hard water the compositions #2 and #3 are almost four times more efficient than the composition #1 and when used with soft water the compositions #2 and #3 are two times more efficient than the composition #1.

The above results surprisingly show that the use of diluted compositions according to the present invention provides a significant benefit in grease cleaning compared to the composition comprising only nonionic surfactant with a moderate HLB (for example 12), both in hard and soft water.

EXAMPLE II

A concentrated composition is prepared with the following composition:

| Ingredients | Weight % |
|---|---|
| Alfonic 810-60 ($C_8$–$C_{10}$ $E_6$) | 20.0 |
| Neodol 23-3 ($C_{12}$–$C_{13}$ $E_3$) | 4.0 |
| Coconut fatty acid | 0.6 |
| Monoethanolamine | 1.0 |
| Sodium cumene sulfonate | 1.5 |
| Minors and water | Balance |

This composition provides good performance while requiring less packaging.

What is claimed is:

1. An aqueous alkaline cleaning composition comprising, by weight of the total neat composition, from 0.5% to 30% of a nonionic surfactant system and from 0.1% to 10% of alkanolamine, characterized in that said nonionic surfactant system consists essentially of alkoxylated alcohols, alkoxylated phenylalcohols, or mixtures thereof and that:

at least 0.1% by weight of the total neat composition is a first highly hydrophilic nonionic surfactant of the formula $RO\text{-}(C_2H_4O)_n(C_3H_6O)_mH$ wherein R is a $C_{8\text{-}22}$ alkyl chain or a $C_{8\text{-}28}$ alkyl benzene chain, n and m are each from 0 to 100 and n+m is from 6 to 100, said first highly hydrophilic nonionic surfactant having an HLB of from 12 to 20, and at least 0.1% by weight of the total neat composition is a second highly hydrophobic nonionic surfactant of the formula $RO\text{-}(C_2H_4O)_n(C_3H_6O)_mH$ wherein R is as defined above, n and m are each from 0 to 5 and n+m is from 0.5 to 5, said second highly hydrophobic nonionic surfactant having an HLB of from 2 to 10 and at least 4 less than the HLB of said first highly hydrophilic nonionic surfactant.

2. The composition of claim 1 wherein said composition additionally comprises from 3% to 15% by weight of the total neat composition, of solvent selected from the group consisting of: propylene glycol derivatives; 2-(2-alkoxyethoxy)ethanols; benzyl alcohol; 2-ethyl-1,3-hexanediol; 2,2,4-trimethyl-1,3-pentanediol; and mixtures thereof.

3. The composition of claim 2 additionally comprising from 1% to 15% of builder by weight of the total neat composition.

4. The composition of claim 1 additionally comprising from 1% to 15% of builder by weight of the total neat composition.

* * * * *